US007201473B2

(12) United States Patent
Sakaida

(10) Patent No.: US 7,201,473 B2
(45) Date of Patent: Apr. 10, 2007

(54) INKJET PRINTING HEAD

(75) Inventor: Atsuo Sakaida, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 126 days.

(21) Appl. No.: 10/874,331

(22) Filed: Jun. 24, 2004

(65) Prior Publication Data

US 2004/0263581 A1 Dec. 30, 2004

(30) Foreign Application Priority Data

Jun. 30, 2003 (JP) ..... 2003-187730

(51) Int. Cl.
*B41J 2/045* (2006.01)

(52) U.S. Cl. ..... 347/68; 347/70

(58) Field of Classification Search ..... 347/68, 347/70–72; 29/25.35
See application file for complete search history.

(56) References Cited

U.S. PATENT DOCUMENTS

| | | | | |
|---|---|---|---|---|
| 5,639,508 | A * | 6/1997 | Okawa et al. | 427/100 |
| 6,223,405 | B1 | 5/2001 | Oikawa et al. | |
| 6,488,355 | B2 | 12/2002 | Nakamura et al. | |
| 6,623,111 | B2 * | 9/2003 | Nakatani | 347/72 |
| 6,682,175 | B2 | 1/2004 | Otsuka et al. | |
| 2002/0003560 | A1 | 1/2002 | Isono et al. | |
| 2002/0080215 | A1 | 6/2002 | Sakaida et al. | |

FOREIGN PATENT DOCUMENTS

| | | |
|---|---|---|
| EP | 0 877 430 A2 | 11/1998 |
| EP | 1 138 493 A1 | 10/2001 |
| EP | 1 316 427 A1 | 6/2003 |
| JP | A 2001-334661 | 12/2001 |
| JP | A 2002-292860 | 10/2002 |
| JP | A 2003-72068 | 3/2003 |

* cited by examiner

*Primary Examiner*—An H. Do
(74) *Attorney, Agent, or Firm*—Oliff & Berridge, PLC

(57) ABSTRACT

An inkjet printing head includes: a flow path unit including pressure chambers arranged along a plane and connected to nozzles respectively; and an actuator unit being fixed to a surface of the flow path unit and changes volume of each of the pressure chambers, the actuator unit including: a plurality of individual electrodes each arranged in positions opposite to the pressure chambers respectively; a common electrode provided to extend over the pressure chambers; and a piezoelectric sheet provided between the common electrode and the individual electrodes, wherein actuator elements in which configured by laminating each of the individual electrodes, the common electrode and the piezoelectric sheet, are formed in a different structure depending on a position in the actuator unit, the position where each of the actuator elements is disposed.

19 Claims, 12 Drawing Sheets

INKJET PRINTING HEAD

BACKGROUND OF THE INVENTION

1. Field of the Invention

The present invention relates to an inkjet printing head for ejecting ink onto a recording medium to perform printing.

2. Description of the Related Art

An inkjet printing head has been disclosed in JP-A-2002-292860 (specifically, in FIG. 1 thereof). In the inkjet printing head, a large number of pressure chambers are formed in a flow path unit and arranged in the form of a matrix so as to be adjacent to one another. A piezoelectric device and one electrode (common electrode) are provided in the form of a sheet so as to extend over the pressure chambers. Other electrodes (individual electrodes) are arranged in positions opposite to the pressure chambers respectively so that the piezoelectric device is put between the common electrode and the individual electrodes. According to the inkjet printing head, when the electric potential of each individual electrode is made different from that of the common electrode, ink is ejected from a nozzle connected to a pressure chamber corresponding to the individual electrode.

SUMMARY OF THE INVENTION

The inventor has found that image quality is largely affected by the fact that the velocity of ink ejected from a nozzle connected to a pressure chamber corresponding to a central portion of a piezoelectric sheet is higher than the velocity of ink ejected from a nozzle connected to a pressure chamber corresponding to an outer edge portion of the piezoelectric sheet in the inkjet printing head of this type disclosed in JP-A-2002-292860.

Therefore, one of objects of the invention is to provide an inkjet printing head including a piezoelectric sheet and a common electrode provided so as to extend over a plurality of pressure chambers, in which velocities of ink ejected from nozzles can be almost equalized.

According to one aspect of the invention, there is provided an inkjet printing head including: a flow path unit including pressure chambers arranged along a plane and connected to nozzles respectively; and an actuator unit being fixed to a surface of the flow path unit and changes volume of each of the pressure chambers, the actuator unit including: a plurality of individual electrodes each arranged in positions opposite to the pressure chambers respectively; a common electrode provided to extend over the pressure chambers; and a piezoelectric sheet provided between the common electrode and the individual electrodes, wherein actuator elements in which configured by laminating each of the individual electrodes, the common electrode and the piezoelectric sheet, are formed in a different structure depending on a position in the actuator unit, the position where each of the actuator elements is disposed.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

Figure 1:
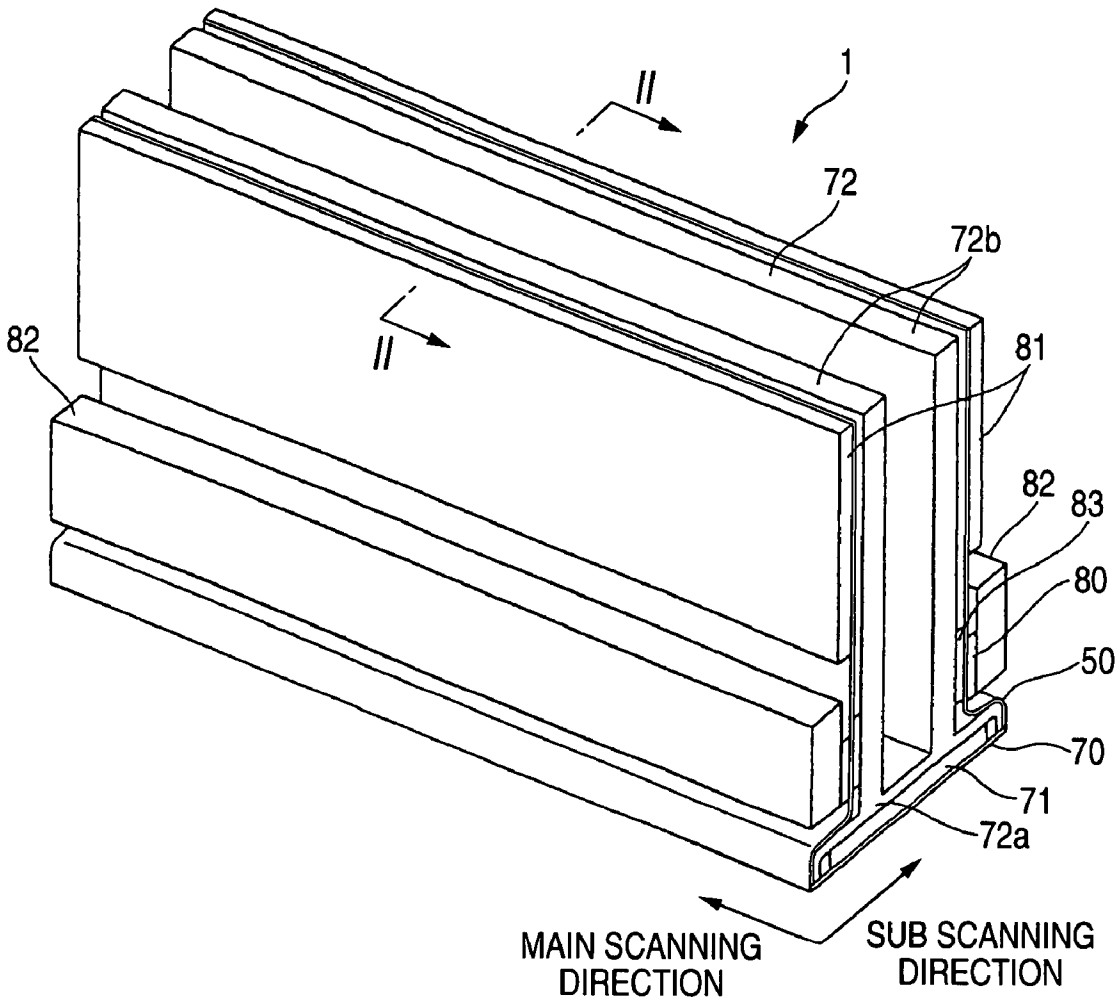
FIG. 1 is a perspective view of an inkjet printing head according to a first embodiment of the invention.
Figure 2:
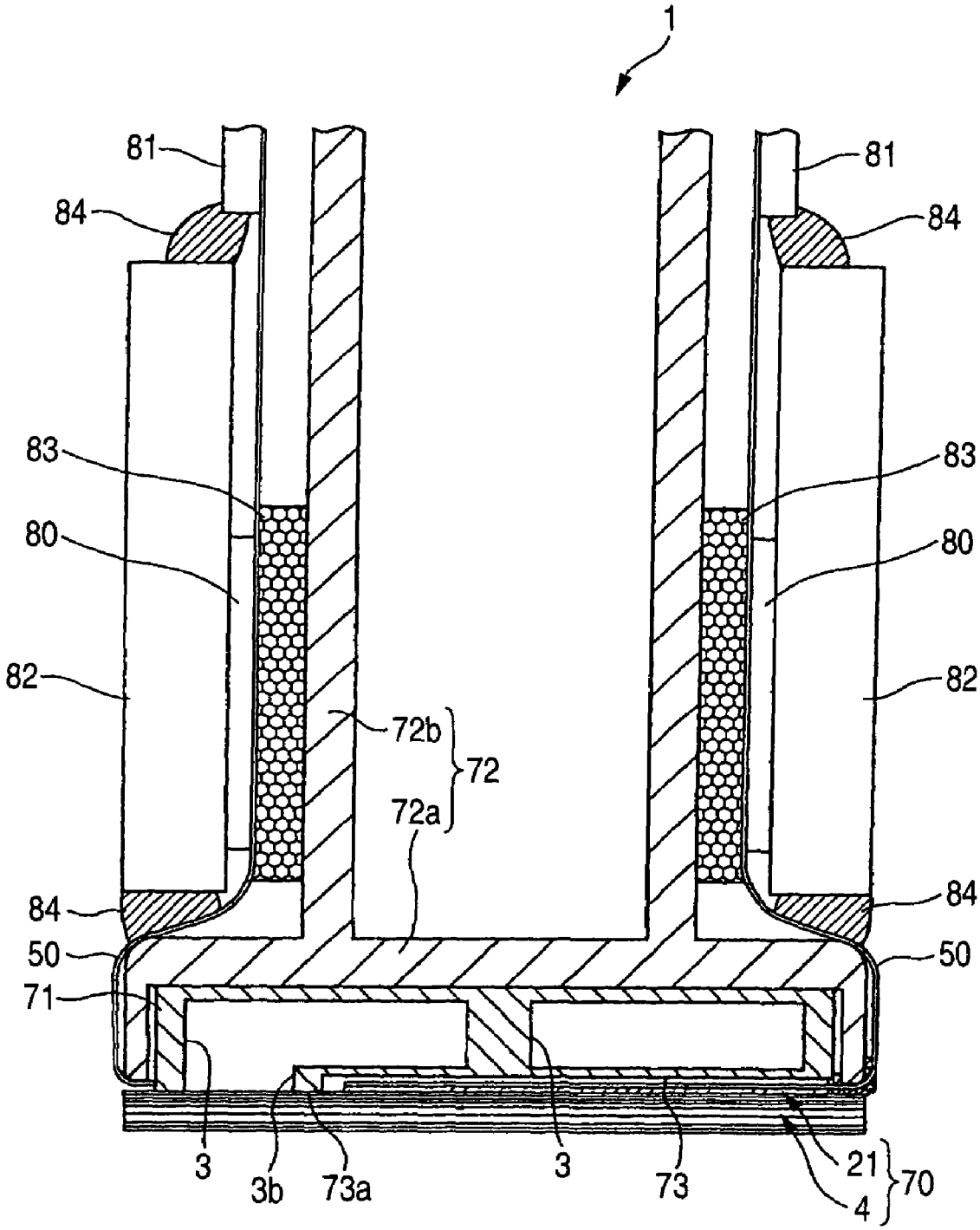
FIG. 2 is a sectional view taken along the line II—II in FIG. 1.

FIG. 1 is a perspective view showing the external appearance of an inkjet printing head according to a first embodiment. FIG. 2 is a sectional view taken along the line II—II in FIG. 1. The inkjet printing head 1 has a head body 70, and a base block 71. The head body 70 is shaped like a flat rectangle extending in a main scanning direction for ejecting ink onto a sheet of paper. The base block 71 is disposed above the head body 70 and includes ink reservoirs 3 formed as flow paths of ink supplied to the head body 70.

The head body 70 includes a flow path unit 4, and a plurality of actuator units 21. An ink flow path is formed in the flow path unit 4. The plurality of actuator units 21 are bonded onto an upper surface of the flow path unit 4. The flow path unit 4 and actuator units 21 are formed in such a manner that a plurality of thin plate members are laminated and bonded to one another. Flexible printed circuit boards (hereinafter referred to as FPCs) 50 which are feeder circuit members are bonded onto an upper surface of the actuator units 21 and pulled out in left and right direction. The FPCs 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 (shown in FIG. 3) only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go along surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 (will be described later in detail) by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICs 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50 respectively. That is, the heat sinks 82, the boards 81 and the FPCs 50 are bonded to one another by the seal members 84.

Figure 3:
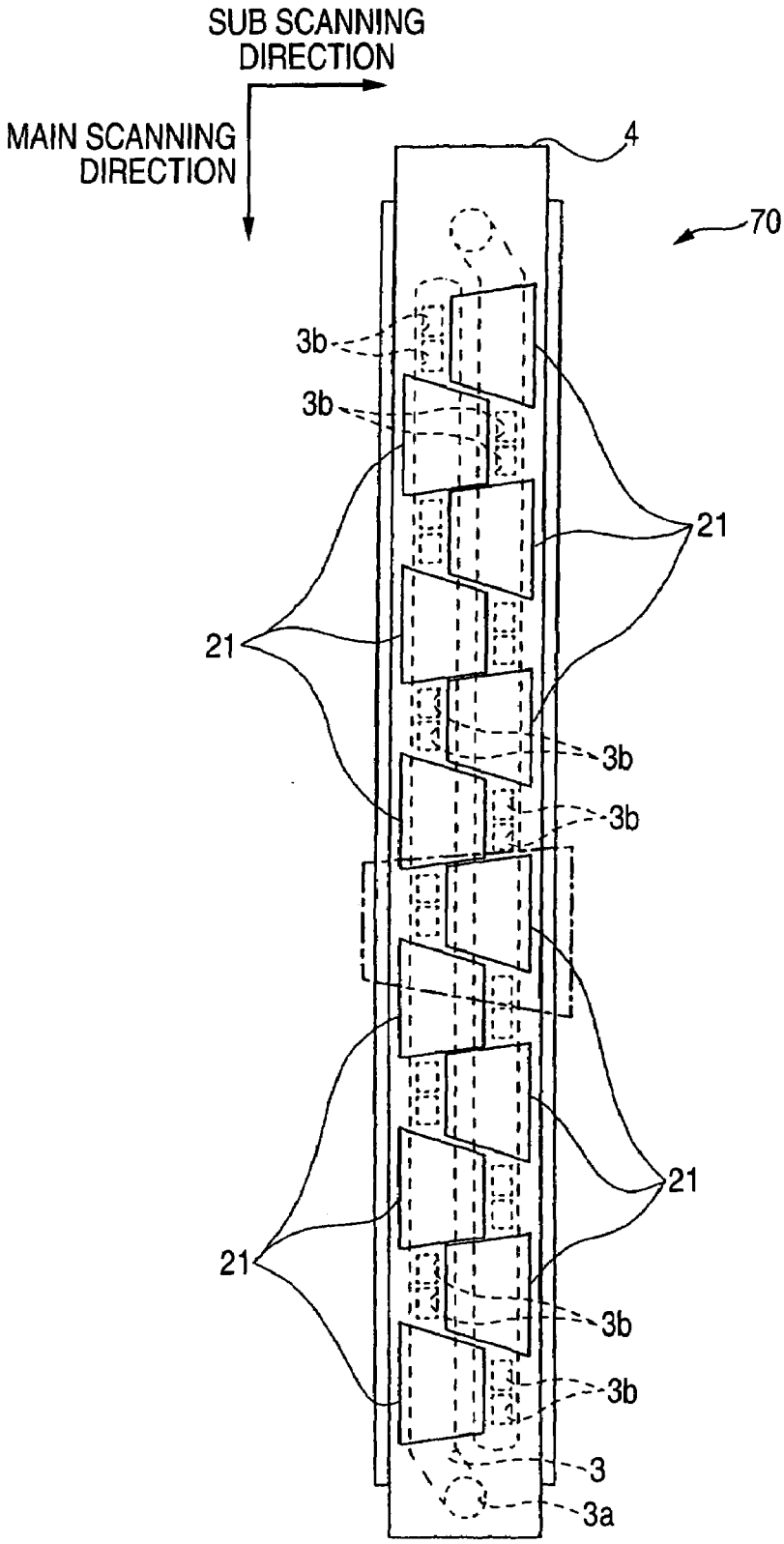
FIG. 3 is a plan view of a head body included in the inkjet printing head depicted in FIG. 2.

FIG. 3 is a plan view of the head body included in the inkjet printing head depicted in FIG. 1. In FIG. 3, the ink reservoirs 3 formed in the base block 71 are drawn virtually by the broken line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are arranged in staggered layout.

The plurality of actuator units 21 each having a trapezoid flat shape are disposed in regions where the openings 3*b* are not provided. The plurality of actuator units 21 are arranged in staggered manner so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 70.

Figure 4:
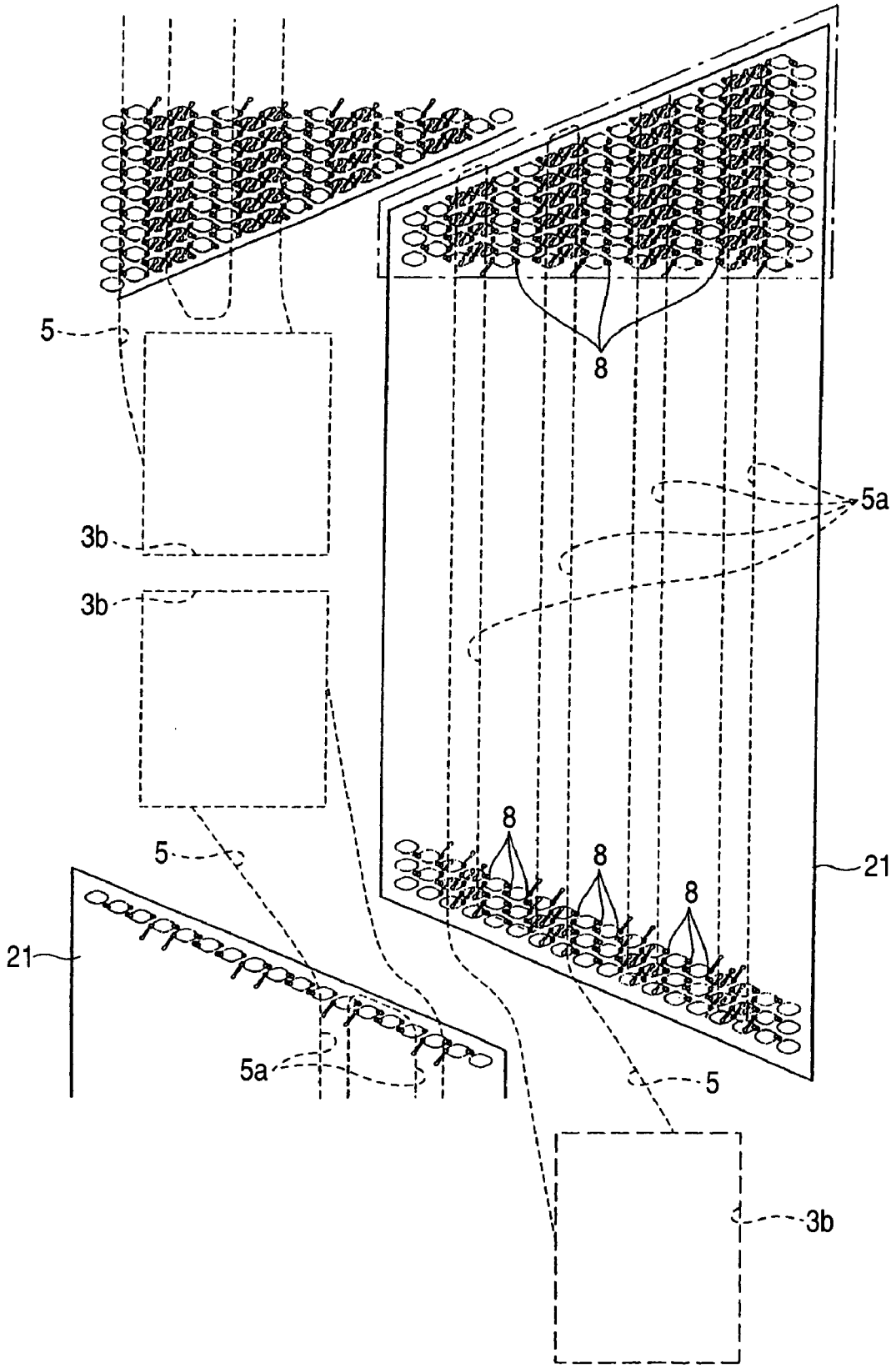
FIG. 4 is an enlarged view of a region surrounded by the chain line shown in FIG. 3.

FIG. 4 is an enlarged view of a region surrounded by the chain line in FIG. 3. As shown in FIG. 4, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* separated from adjacent openings 3*b* extend from two inclined sides of each actuator unit 21. That is, four sub manifolds 5*a* in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 4 shows several nozzles 8 for the sake of simplification, nozzles 8 are actually arranged on the whole of the ink ejection region.

Figure 5:
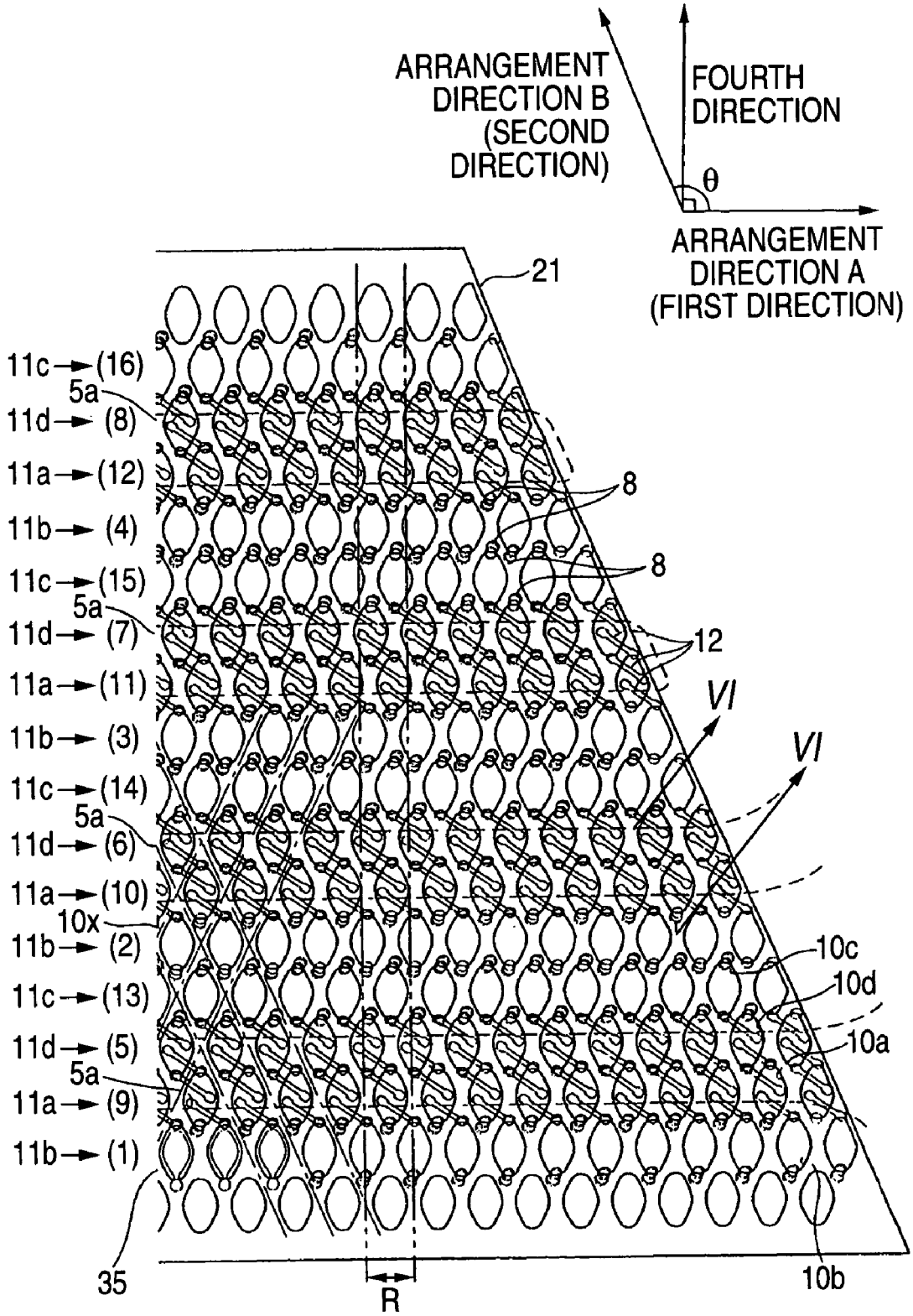
FIG. 5 is an enlarged view of a region surrounded by the chain line shown in FIG. 4.

FIG. 5 is an enlarged view of a region surrounded by the chain line in FIG. 4. FIGS. 4 and 5 show a state in which a plane of a large number of pressure chambers 10 disposed in the form of a matrix in the flow path unit 4 is viewed from a direction perpendicular to the ink ejection surface. Each of the pressure chambers 10 is shaped substantially like a rhomboid having rounded corners in plan view. The long diagonal line of the rhomboid is parallel to the direction of the width of the flow path unit 4. Each pressure chamber 10 has one end connected to a corresponding nozzle 8, and the other end connected to a corresponding sub manifold 5*a* as a common ink flow path through an aperture 12. An individual electrode 35 having a planar shape similar to but size smaller than that of each pressure chamber 10 is formed on the actuator unit 21 so as to be adjacent to the pressure chamber 10 in plan view. Some of a large number of individual electrodes 35 are shown in FIG. 5 for the sake of simplification. Incidentally, the pressure chambers 10 and apertures 12 that must be expressed by the broken line in the actuator units 21 or in the flow path unit 4 are expressed by the solid line in FIGS. 4 and 5 to make it easy to understand the drawings.

In FIG. 5, a plurality of virtual rhombic regions 10 in which the pressure chambers 10 are stored respectively are disposed adjacently in the form of a matrix both in an arrangement direction A (first direction) and in an arrangement direction B (second direction) so that adjacent virtual rhombic regions 10*x* have common sides not overlapping each other. The arrangement direction A is a direction of the length of the inkjet printing head 1, that is, a direction of extension of each sub manifold 5*a*. The arrangement direction A is parallel to the short diagonal line of each rhombic region 10*x*. The arrangement direction B is a direction of one inclined side of each rhombic region 10*x* in which an obtuse angle θ is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 10 disposed adjacently in the form of a matrix in the two arrangement directions A and B are formed at intervals of a distance corresponding to 37.5 dpi along the arrangement direction A. The pressure chambers 10 are formed so that sixteen pressure chambers 10 are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*->11*d*->11*a*->11*b*->11*c*->11*d*-> . . . ->11*b* from an upper side to a lower side of each actuator unit 21.

In pressure chambers 10*a* forming the first pressure chamber column 11*a* and pressure chambers 10*b* forming the second pressure chamber column 11*b*, nozzles 8 are unevenly distributed on a lower side of the paper surface of FIG. 5 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming the third pressure chamber column 11*c* and pressure chambers 10*d* forming the fourth pressure chamber column 11*d*, nozzles 8 are unevenly distributed on an upper side of the paper surface of FIG. 5 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 6:
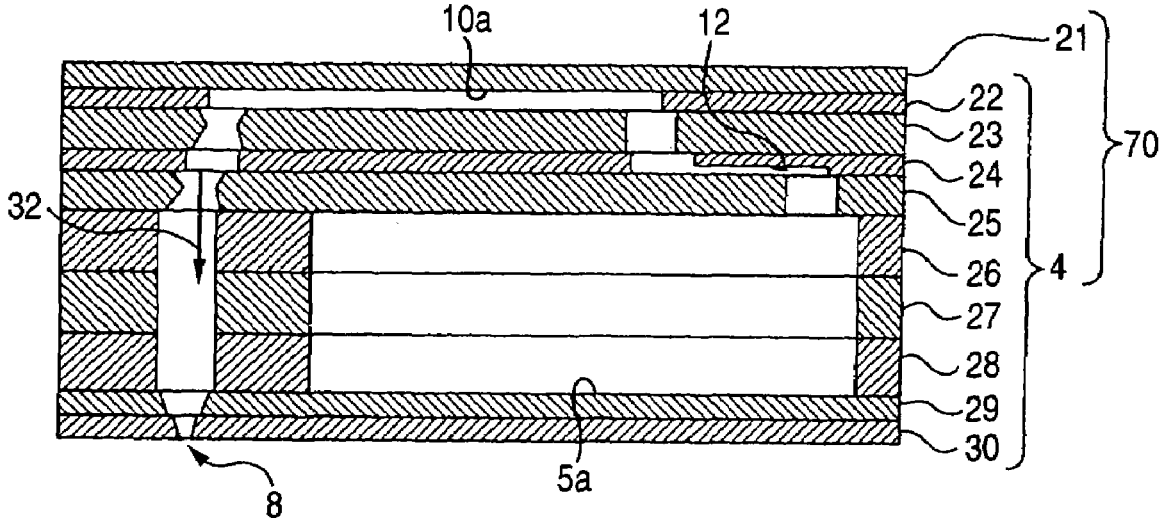
FIG. 6 is a sectional view taken along the line VI—VI in FIG. 5.

Next, the sectional structure of the head body 70 will be further described with reference to FIGS. 6 and 7. FIG. 6 is a sectional view taken along the line VI—VI in FIG. 5. FIG. 6 shows a pressure chamber 10*a* belonging to the first pressure chamber column 11*a*. As is obvious from FIG. 6, each nozzle 8 is connected to a sub manifold 5*a* through the pressure chamber 10*a* and an aperture 12. In this manner, an individual ink flow path 32 extending from an outlet of the sub manifold 5*a* to the nozzle 8 through the aperture 12 and the pressure chamber 10 is formed in the head body 70 in accordance with the pressure chamber 10.

As is obvious from FIG. 6, the pressure chamber 10 and the aperture 12 are provided in different depths in a direction of lamination of the plurality of thin plates. Accordingly, as shown in FIG. 5, in the flow path unit 4 corresponding to the ink ejection region below the actuator unit 21, an aperture 12 connected to one pressure chamber 10 can be disposed so as to overlap the position of a pressure chamber 10 adjacent to the pressure chamber in plan view. As a result, the pressure chambers 10 adhere to each other so as to be arranged densely. Accordingly, printing of a high-resolution image can be achieved by the inkjet printing head 1 having a relatively small required area.

Figure 7:
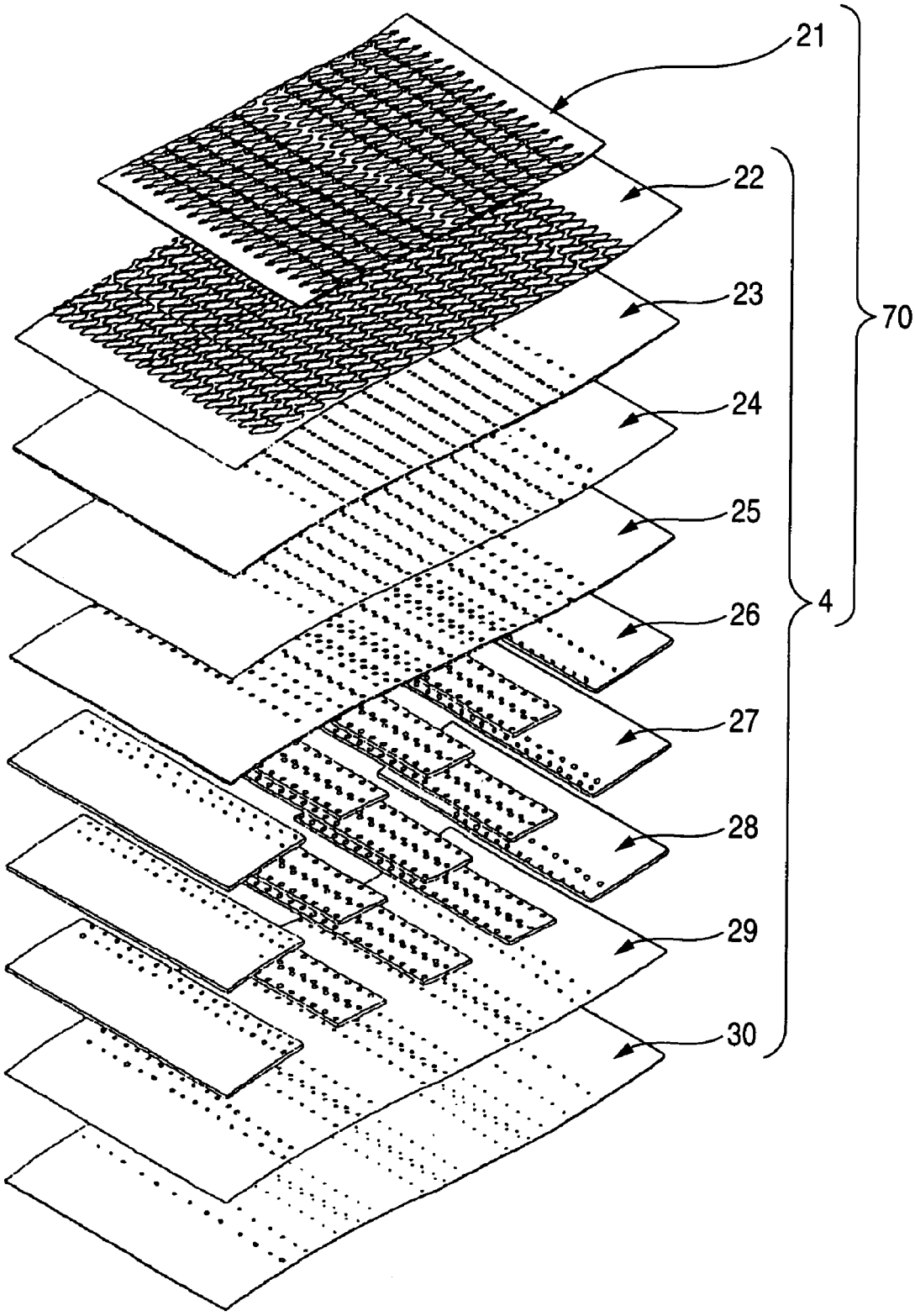
FIG. 7 is a partially exploded perspective view of the head body depicted in FIG. 6.

As is also obvious from FIG. 7, the head body 70 has a laminated structure in which ten sheet materials in total are laminated on one another, that is, an actuator unit 21, a cavity plate 22, a base plate 23, an aperture plate 24, a supply plate 25, manifold plates 26, 27 and 28, a cover plate 29 and a nozzle plate 30 are laminated in descending order. The ten sheet materials except the actuator unit 21 of a ceramic material, that is, nine metal plates 22 to 30 form a flow path unit 4. The actuator unit 21 and the flow path unit 4 are fixed to each other by an adhesive agent while heated. In this embodiment, each of the metal plates 22 to 30 for forming the flow path unit 4 is made of stainless steel and has a thermal expansion coefficient higher than that of the actuator unit 21 made of a ceramic material.

As will be described later in detail, the actuator unit 21 includes a laminate of four piezoelectric sheets 41 to 44 (see FIGS. 10A and 10B) as four layers, and electrodes disposed so that only the uppermost layer is provided as a layer having a portion serving as an active layer at the time of application of electric field (hereinafter referred to as "active layer-including layer") while the residual three layers are provided as non-active layers. The cavity plate 22 is a metal plate having a large number of approximately rhomboid openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding nozzle 8. The aperture plate 24 is a metal plate which has apertures 12 (see FIG. 9), and holes 12*d* each for connecting one pressure chamber 10 of the cavity plate 22 to a corresponding nozzle 8. Each of the apertures 12 has an ink inlet 12*a* on the sub manifold 5*a* side, an ink outlet 12*b* on the pressure chamber 10 side, and a communication portion 12*c* formed slimly while connected to the ink inlet and outlet 12*a* and 12*b*. The supply plate 25 is a metal plate which has holes each for connecting an aperture 12 for one pressure chamber 10 of the cavity plate 22 to a corresponding sub manifold 5*a*, and holes each for connecting the pressure chamber 10 to the nozzle 8. The manifold plates 26, 27 and 28 are metal plates which have the sub manifolds 5*a*, and holes each for connecting one pressure chamber 10 of the cavity plate 22 to a corresponding nozzle 8. The cover plate 29 is a metal plate which has holes each for connecting one pressure chamber 10 of the cavity plate 22 to a corresponding nozzle 8. The nozzle plate 30 is a metal plate which has nozzles 8 each provided for one pressure chamber 10 of the cavity plate 22.

Figure 8:
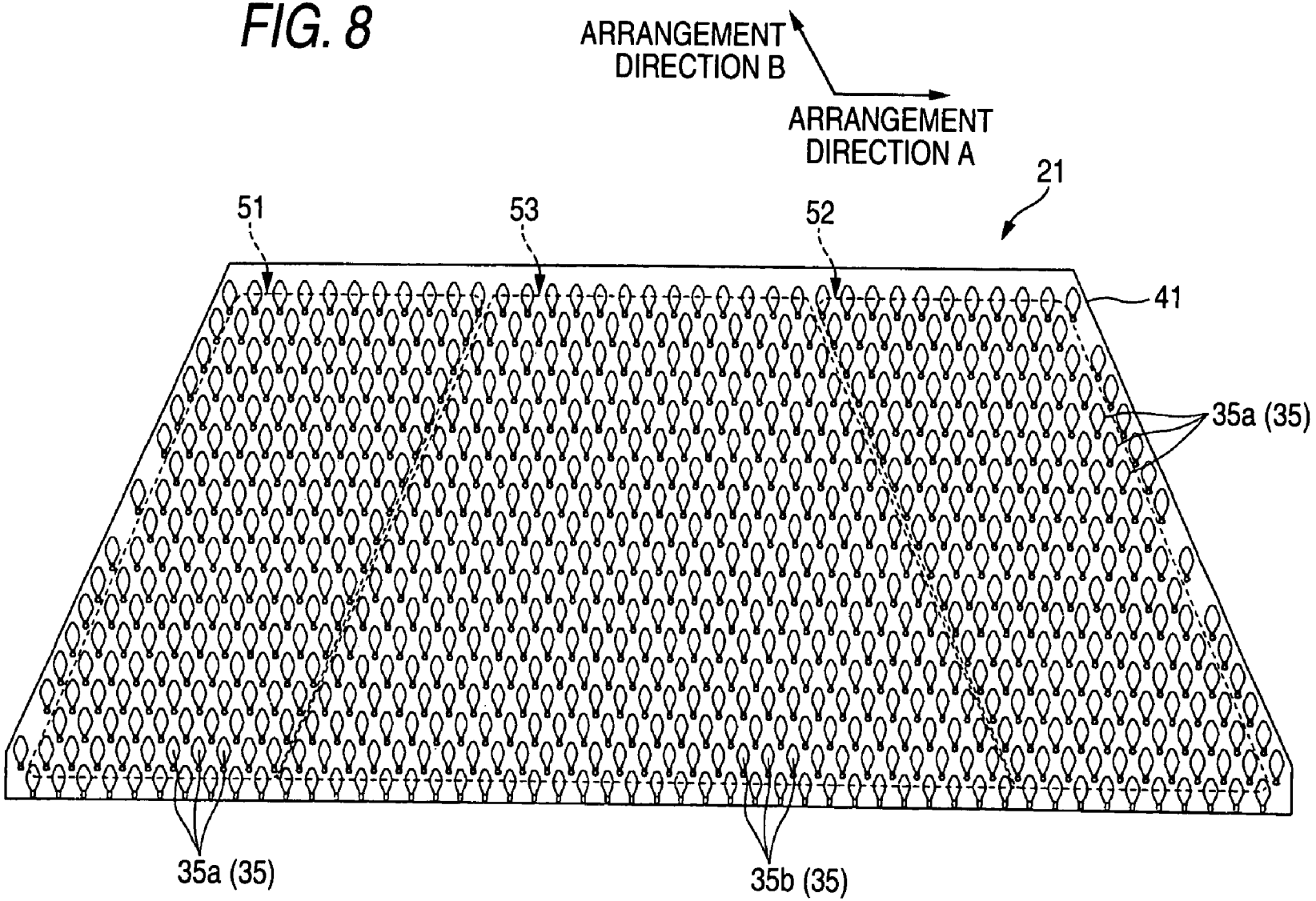
FIG. 8 is a plan view of an actuator unit depicted in FIG. 6.

The ten sheets 21 to 30 are laminated while positioned so that individual ink flow paths 32 are formed as shown in FIG. 6. Each individual ink flow path 32 first goes upward from the sub manifold 5*a*, extends horizontally in the aperture 12, goes further upward from the aperture 12, extends horizontally again in the pressure chamber 10, momentarily goes obliquely downward in the direction of departing from the aperture 12 and goes vertically downward to the nozzle 8.

next, the configuration of the actuator unit 21 will be. described. FIG. 8 is a plan view of the actuator unit 21. A large number of individual electrodes 35 having a pattern equal to the pattern of the pressure chambers 10 are arranged in the form of a matrix on the actuator unit 21. In this case, in accordance with the inventor's knowledge, variation in ink ejection velocity in the actuator unit 21 often occurs along the lengthwise direction of the actuator unit 21. It is conceived that this is caused by the difference in thermal expansion coefficient between the actuator unit 21 and the flow path unit 4 bonded to the actuator unit.21. Hereinafter, more concrete explanation for the above matter will be described.

When manufacturing the inkjet printing head 1, the flow path unit 4 and the actuator unit 21 are contacted with each other via an adhesive agent. while applying pressure and heat. Thereafter, the adhesive agent is cured by cooling down the applied heat taking time of a few minutes. Thereby, the flow path unit 4 and the actuator unit 21 are fixed to each other. When fixing the flow path unit 4 and the actuator unit 21, the actuator unit 21 becomes applied with a stress in an in-plane direction thereof due to the difference of thermal expansion coefficient between the flow path unit 4 and the actuator unit 21. The inventor has discovered that it is determined which of the central portion and the edge portion of the actuator unit 21 is applied with more stress based on the respect that which of the flow path unit 4 and the actuator unit 21 has higher thermal expansion coefficient.

More specifically, when the flow path unit 4 has higher thermal expansion coefficient than the actuator unit 21, the edge portion of the actuator unit 21 becomes applied with more stress than the central portion of the actuator unit 21. When the flow path unit 4 has lower thermal expansion coefficient than the actuator unit 21, the central portion of the actuator unit 21 becomes applied with more stress than the edge portion of the actuator unit 21. In addition, it is discovered by the inventor that the stress applied to the actuator unit 21 becomes more apparent in longitudinal direction of the actuator unit 21.

The inventor has also discovered that the deforming amount (changing amount of the volume) of the pressure chamber 10 when a predetermined voltage is applied to a actuator element (described later) becomes less, i.e. the ink ejection velocity becomes low, in accordance with the amount of stress applied to the actuator unit 21 in a in-plane direction.

In the embodiment, the flow path unit 4 is made of stainless steel, and the actuator unit 21 is made of a ceramic material. Therefore, the flow path unit 4 has higher thermal expansion coefficient than the actuator unit 21. Accordingly, the ink ejecting velocity at both edge portions of the actuator unit 21 with respect to the arrangement direction A becomes larger than that at central portions of the actuator unit 21.

Under the knowledge described above, the inkjet printing head 1 is configured so that each of all of the actuator elements disposed in the actuator unit 21 ejects ink at almost same ejecting velocity with appliance of a predetermined voltage. The configuration of the inkjet printing head 1 will be more specifically described hereinafter.

In the inkjet printing head 1 according to the embodiment, two types of individual electrodes similar in shape to each other but different in planar size (larger one designated by the reference numeral 35*a* and smaller one designated by the reference numeral 35*b*) are prepared as the individual electrodes 35. Individual electrodes 35*a* are. formed in a parallelogrammatic block 51 having a width corresponding to ten individual electrodes and located in the left side along the arrangement direction A (i.e., in the left of the actuator unit 21 in FIG. 8) and a parallelogrammatic block 52 having a width corresponding to ten individual electrodes and located in the right side along the arrangement direction A (i.e., in the right of the actuator unit 21 in FIG. 8). Individual electrodes 35*b* are formed in a trapezoidal block 53 located between the two parallelogrammatic blocks 51 and 52, that is, located in the center of the actuator unit 21. That is, individual electrodes 35*b* belonging to a trapezoidal block 53 are arranged in the central portion when the actuator unit 21 is viewed along the arrangement direction A. On the other hand, individual electrodes 35*a* belonging to parallelogrammatic blocks 51 and 52 are arranged in outer edge portions, that is, in portions adjacent to hypotenuses of a trapezoid of the actuator unit 21 when the actuator unit 21 is viewed along the arrangement direction A.

In the embodiment, a plurality of areas of a trapezoidal block 53 (a first region) and parallelogrammatic blocks 51 and 52 (a second region) are arranged; and either of the two types of individual electrodes 35*a* and 35*b* is disposed at the first and second regions, respectively. As shown in FIG. 8, the actuator unit 21 is divided into three areas (parallelogrammatic blocks 51 and 52, and trapezoidal block 53) by two imaginary dividing lines each respectively parallels to both edge portions (which corresponds to an edge line of the actuator unit 21) at left and right end in FIG. 8. As apparent from FIG. 8, area occupied by the first region (trapezoidal block 53) that is arranged at the central portion of the actuator unit 21 is larger than area occupied by the second region (parallelogrammatic blocks 51 and 52).

Figure 9A:
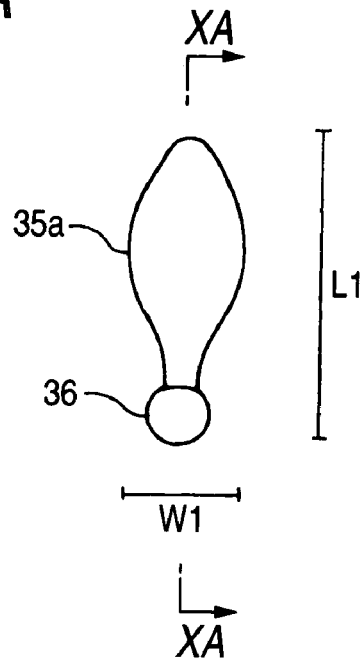
FIG. 9A is a plan view of each of individual electrodes formed on surfaces of left and right blocks of the actuator unit.
Figure 9B:
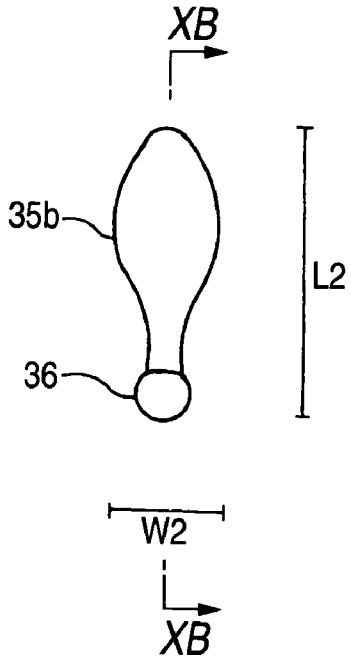
FIG. 9B is a plan view of each of individual electrodes formed on a surface of a central block of the actuator unit.
Figure 10A:
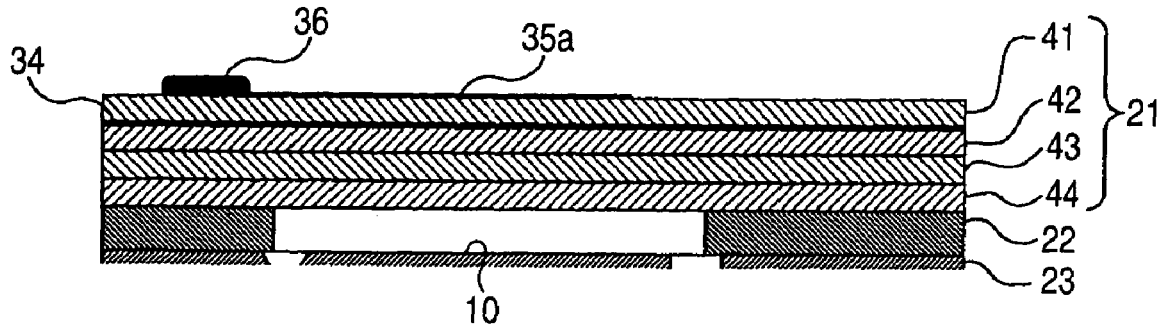
FIG. 10A is a sectional view taken along the line XA—XA in FIG. 9A.
Figure 10B:
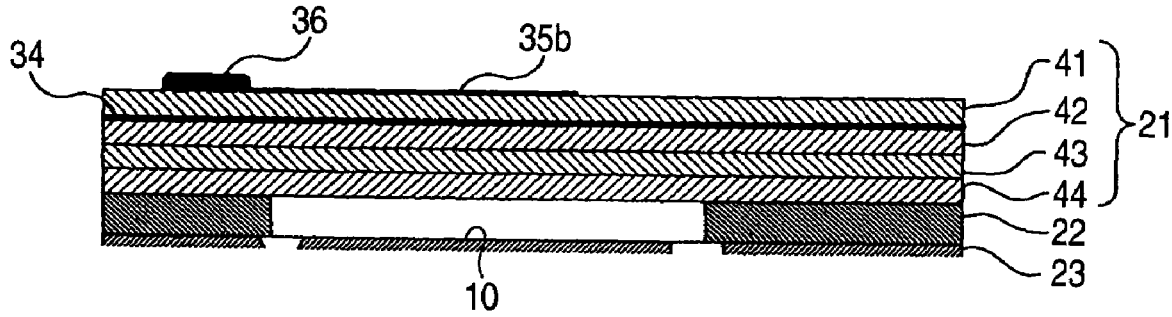
FIG. 10B is a sectional view taken along the line XB—XB in FIG. 9B.

FIG. 9A is a plan view of an individual electrode 35*a*. FIG. 9B is a plan view of an individual electrode 35*b*. FIG. 10A is a sectional view taken along the line XA—XA in FIG. 9A. FIG. 10B is a sectional view taken along the line XB—XB in FIG. 9B.

As shown in FIGS. 10A and 10B, the actuator unit 21 includes four piezoelectric sheets 41, 42, 43 and 44 formed to have a thickness of about 15 μm equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35*a* and 35*b* can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35*a* and 35*b* are formed on the piezoelectric sheet 41 as the uppermost layer. A common electrode 34 having a thickness of about 2 μm is interposed between the piezoelectric sheet 41 as the uppermost layer and the piezoelectric sheet 42 located under the piezoelectric sheet 41 so that the common electrode 34 is formed on the whole surface of the piezoelectric sheet 42. The individual electrodes 35 and the common electrode 34 are made of a metal material such as Ag—Pd.

In the inkjet printing head 1, each of the portions where each of the individual electrodes 35, the common electrode 34, and the four piezoelectric sheets 41, 42, 43 and 44 are laminated functions as the actuator element that changes volume of the pressure chamber 10 formed at the respective position.

As shown in FIGS. 9A and 9B, each of the individual electrodes 35*a* and 35*b* has a rhombic or rhomboid shape in plan view. The rhombic or rhomboid shape is nearly similar to the shape of each pressure chamber 10. A lower acute-angled portion of each of the rhombic or rhomboid individual electrodes 35*a* and 35*b* extends so that a circular land portion 36 electrically connected to each of the individual electrodes 35*a* and 35*b* is provided at an end of the lower acute-angled portion. For example, the land portion 36 is made of gold containing glass frit. As shown in FIGS. 9A and 9B, the land portion 36 is bonded onto a surface of the extension of each of the individual electrodes 35*a* and 35*b*. Although an FPC 50 is not shown in FIGS. 10A and 10B, the land portions 36 are electrically connected to contact points provided in the FPC 50, respectively.

Each individual electrode 35*a* has a length L1 and a width W1. Each individual electrode 35*b* has a length L2 and a width W2. The length L1 and width W1 of the individual electrode 35*a* are selected so that the planar shape of the individual electrode 35*a* can be received in the pressure chamber 10. In this embodiment, the length L1 is 10% larger than the length L2 and the width W1 is 10% larger than the width W2. Theoretically, if an individual electrode 35 has a size sufficient to be received in the pressure chamber 10, the ink ejection velocity increases because of large displacement in the actuator unit 21 as the area of the individual electrode 35 increases. Therefore, the lengths and widths of the two types of individual electrodes 35*a* and 35*b* are decided so that unevenness in ink ejection velocity along the arrangement direction A in the actuator unit 21 is substantially eliminated to make no difference between the average velocity of ink ejected from the nozzles 8 in the parallelogrammatic blocks 51 and 52 and the average velocity of ink ejected from the nozzles 8 in the trapezoidal block 53.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrodes 35*a* and 35*b* is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 are not displaced spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 10A, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

Incidentally, another drive method may be used as follows. The electric potential of each individual electrodes 35*a* and 35*b* is set at a value different from the electric potential of the common electrode 34 in advance. Whenever there is an ejection request, the electric potential of the individual electrodes 35*a* and 35*b* is once changed to the same value as the electric potential of the common electrode 34. Then, the electric potential of the individual electrodes 35*a* and 35*b* is returned to the original value different from the electric potential of the common electrode 34 at predetermined timing. In this case, the piezoelectric sheets 41 to 44 are restored to the original shape at the timing when the electric potential of the individual electrode 35 becomes equal to the electric potential of the common electrode 34. Accordingly, the volume of the pressure chamber 10 is increased compared with the initial state (in which the two electrodes are different in electric potential from each other), so that ink is sucked from the manifold 5 side into the pressure chamber 10. Then, the piezoelectric sheets 41 to 44 are deformed so as to be curved convexly on the pressure chamber 10 side at the timing when the electric potential of the individual electrodes 35*a* and 35*b* is set at the original value different from the electric potential of the common electrode 34 again. As a result, the volume of the pressure chamber 10 is reduced to increase the pressure of ink to thereby eject ink.

Referring back to FIG. 5, a zonal region R having a width (678.0 μm) corresponding to 37.5 dpi in the arrangement direction A and extending in the arrangement direction B will be considered. Only one snozzle 8 is present in any one of sixteen pressure chamber columns 11*a* to lid in the zonal region R. That is, when such a zonal region R is formed in an optional position of the ink ejection region corresponding to one actuator unit 21, sixteen nozzles 8 are always distributed in the zonal region R. The positions of points obtained by projecting the sixteen nozzles 8 onto a line extending in the arrangement direction A are arranged at intervals of a distance corresponding to 600 dpi which is resolution at the time of printing.

When the sixteen nozzles 8 belonging to one zonal region R are numbered as (1) to (16) in rightward order of the positions of points obtained by projecting the sixteen nozzles 8 onto a line extending in the arrangement direction A, the sixteen nozzles 8 are arranged in ascending order of (1), (9), (5), (13), (2), (10), (6), (14), (3), (11), (7), (15), (4), (12), (8) and (16). When the inkjet printing head 1 configured as described above is driven suitably in accordance with conveyance of a printing medium in the actuator unit 21, characters, graphics, etc. having resolution of 600 dpi can be drawn.

For example, description will be made on the case where a line extending in the arrangement direction A is printed with resolution of 600 dpi. First, brief description will be made on the case of a reference example in which each nozzle 8 is connected to the acute-angled portion on the same side of the pressure chamber 10. In this case, a nozzle 8 in the pressure chamber column located in the lowermost position in FIG. 5 begins to eject ink in accordance with conveyance of the printing medium. Nozzles 8 belonging to adjacent pressure chamber columns on the upper side are selected successively to eject ink. Accordingly, dots of ink are formed so as to be adjacent to one another at intervals of a distance corresponding to 600 dpi in the arrangement direction A. Finally, a line extending in the arrangement direction A is drawn with resolution of 600 dpi as a whole.

On the other hand, in this embodiment, a nozzle 8 in the pressure chamber column 11*b* located in the lowermost position in FIG. 5 begins to eject ink. As the printing medium is conveyed, nozzles 8 connected to adjacent pressure chambers on the upper side are selected successively to eject ink. On this occasion, the displacement of the nozzle 8 position in the arrangement direction A in accordance with increase in position by one pressure chamber column from the lower side to the upper side is not constant. Accordingly, dots of ink formed successively along the arrangement direction A in accordance with conveyance of the printing medium are not arranged at regular intervals of 600 dpi.

That is, as shown in FIG. 5, ink is first ejected from the nozzle (1) connected to the pressure chamber column 11*b* located in the lowermost position in FIG. 5 in accordance with conveyance of the printing medium. A row of dots are formed on the printing medium at intervals of a distance corresponding to 37.5 dpi. Then, when the line forming position reaches the position of the nozzle (9) connected to the second lowest pressure chamber column 11*a* as the printing medium is conveyed, ink is ejected from the nozzle (9). As a result, a second ink dot is formed in a position displaced by eight times as large as the distance corresponding to 600 dpi in the arrangement direction A from the initial dot position.

Then, when the line forming position reaches the position of the nozzle (5) connected to the third lowest pressure chamber column 11*d* as the printing medium is conveyed, ink is ejected from the nozzle (5). As a result, a third ink dot is formed in a position displaced by four times as large as the distance corresponding to 600 dpi in the arrangement direction A from the initial dot position. When the line forming position reaches the position of the nozzle (13) connected to the fourth lowest pressure chamber column 11*c* as the printing medium is further conveyed, ink is ejected from the nozzle (13). As a result, a fourth ink dot is formed in a position displaced by twelve times as large as the distance corresponding to 600 dpi in the arrangement direction A from the initial dot position. When the line forming position reaches the position of the nozzle (2) connected to the fifth lowest pressure chamber column 11*b* as the printing medium is further conveyed, ink is ejected from the nozzle (2). As a result, a fifth ink dot is formed in a position displaced by the distance corresponding to 600 dpi in the arrangement direction A from the initial dot position.

Then, ink dots are formed in the same manner as described above while nozzles 8 connected to the pressure chambers 10 are selected successively from the lower side to the upper side in FIG. 5. When N is the number of a nozzle 8 shown in FIG. 5 on this occasion, an ink dot is formed in a position displaced by a value corresponding to (the ratio n−N−1)×(the distance corresponding to 600 dpi) in the arrangement direction A from the initial dot position. Finally, when selection of the sixteen nozzles 8 is completed, fifteen dots formed at intervals of a distance corresponding to 600 dpi are interpolated in between ink dots formed at intervals of a distance corresponding to 37.5 dpi by the nozzle (1) in the lowest pressure chamber column 11*b* in FIG. 5. As a result, a line extending in the arrangement direction A can be drawn with resolution of 600 dpi as a whole.

Incidentally, printing with resolution of 600 dpi can be achieved when neighbors of opposite end portions of each ink ejection region (inclined sides of each actuator unit 21) in the arrangement direction A are complementary to neighbors of opposite end portions of corresponding ink ejection regions in the arrangement direction A to other actuator unit 21 opposed to the actuator unit 21 in the direction of the width of the head body 70.

As is obvious from the above description, in the inkjet printing head 1 according to this embodiment, the planar size of each of the individual electrodes 35*a* formed in the parallelogrammatic blocks 51 and 52 is larger than the planar size of each of the individual electrodes 35*b* formed in the trapezoidal block 53 while the common electrode 34 is provided to extend over the whole of the actuator unit 21. Accordingly, the facing area between the common electrode 34 and the individual electrodes 35 in the parallelogrammatic blocks 51 and 52 is larger than that in the trapezoidal block 53. The electrode-facing area in each of the blocks 51, 52 and 53 is equal to the area of the individual electrodes in each of the blocks 51, 52 and 53. if the electrode-facing areas in the three blocks 51, 52 and 53 are not adjusted, image quality deteriorates because of large variation in ink ejection velocity particularly in the arrangement direction A. In this embodiment, the electrode-facing areas are however adjusted so that the average ink ejection velocities in the three blocks 51, 52 and 53 are almost equalized. Accordingly, image quality of a print image is improved greatly. Moreover, equalization of ink ejection velocity based on the adjustment of the electrode-facing areas in this embodiment has an advantage on design in that it is almost unnecessary to change dimension parameters and control parameters except the planar shapes of the electrodes when such adjustment is performed.

In this embodiment, the planar sizes of the individual electrodes 35 are changed in accordance with the blocks in the actuator unit 21 to adjust the electrode-facing areas. Accordingly, it is unnecessary to change the shape of the common electrode 34, so that the facing area between the common electrode 34 and the individual electrodes 35 can be adjusted easily.

Moreover, in this embodiment, the actuator unit 21 is separated into the three blocks 51, 52 and 53 so that the planar sizes of the individual electrodes 35 in each block are equalized. Accordingly, it is easy to produce the actuator unit 21 because the planar sizes pf the individual electrodes 35 can be changed in accordance with the blocks though the effect of adjusting variation in ink ejection velocity is slightly lower than that in the case where the planar sizes of the individual electrodes 35 are adjusted without provision of any block.

Incidentally, in a modification of this embodiment, the theory in which the ink ejection velocity is made slower because the rigidity of the individual electrodes 35 per se becomes higher sufficiently to be hardly deformed as the individual electrodes 35 become thicker may be used in addition to the adjustment of the planar sizes of the individual electrodes 35. That is, when the individual electrodes 35*b* are made thicker than the individual electrodes 35*a*, variation in ink ejection velocity can be reduced. In this case, the difference in ink ejection velocity can be compensated for not only by the adjustment of the electrode-facing areas but also by the adjustment of the thicknesses of the individual electrodes 35, so that ink ejection velocity can be equalized even in the case where the ink ejection velocity varies originally widely.

In another modification of this embodiment, the shape of the common electrode 34 may be adjusted while the planar sizes of the individual electrodes 35 are made common to the blocks 51, 52 and 53 so that the electrode-facing area in the blocks 51 and 52 can be made larger than the electrode-facing area in the block 53. Or the individual electrodes 35 and the common electrode 34 may be adjusted to control the electrode-facing areas.

Next, a second embodiment of the invention will be described. The inkjet printing head according to this embodiment is partially different from that according to the first embodiment in the shapes of the individual electrodes 35. That is, the inkjet printing head in this embodiment is the same as that in the first embodiment with respect to the structure shown in FIGS. 1 to 7 but is different from that in the first embodiment with respect to the structure shown in FIGS. 8, 9A, 9B, 10A and 10B. Accordingly, description will be made mainly on the point of difference. Members the same as those in the first embodiment are denoted by the same reference numerals as those in the first embodiment for the sake of omission of duplicated description.

Figure 11A:
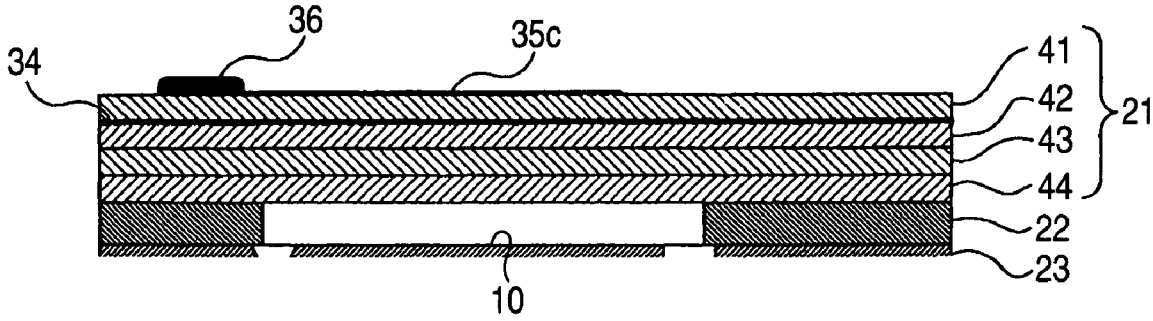
FIG. 11A is a sectional view corresponding to FIG. 10A and showing the head body of the inkjet printing head according to a second embodiment of the invention.
Figure 11B:
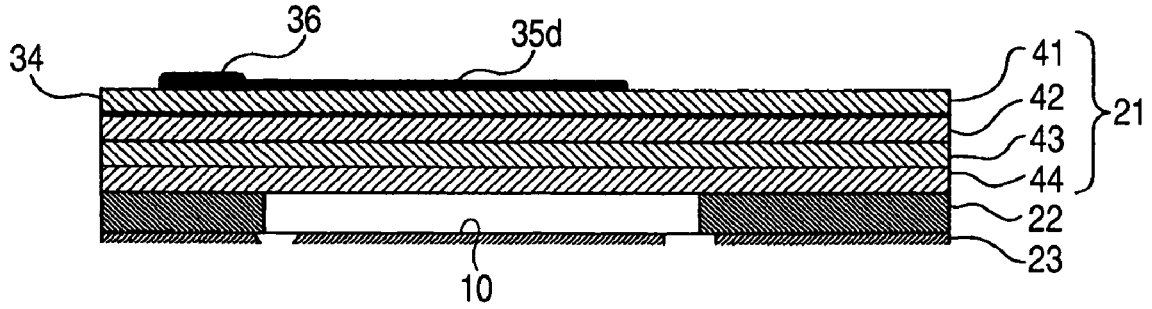
FIG. 11B is a sectional view corresponding to FIG. 10B.

FIG. 11A is a sectional view of the head body according to this embodiment. FIG. 11A corresponds to FIG. 11A. FIG. 11B is a sectional view of the head body according to this embodiment. FIG. 11B corresponds to FIG. 10B. In this embodiment, the three blocks 51, 52 and 53 shown in FIG. 8 are provided so that individual electrodes 35*c* are formed in the blocks 51 and 52 while individual electrodes 35*d* are formed in the block 53. Each of the individual electrodes 35*c* and 35*d* has a planar size equal to that of the individual electrode 35*a* shown in FIG. 9A. As is obvious from FIGS. 11A and 11B, each individual electrode 35*d* is thicker than each individual electrode 35*c*. This is for the following reason. If an individual electrode 35 becomes thicker, the rigidity of the individual electrode 35 per se becomes so higher that the thick electrode disturbs displacement of the active layer of the actuator unit 21 even in the case where a predetermined drive voltage is applied on the electrode. As a result, ink ejection velocity can be made slower. This theory is used for adjusting the average ink ejection velocities in the three blocks 51, 52 and 53.

In this embodiment, the thicknesses of the individual electrodes 35*c* and 35*d* are adjusted so that the average ink ejection velocities in the three blocks 51, 52 and 53 are almost equalized. If there is no adjustment, variation in ink ejection velocity particularly along the arrangement direction A becomes so large that the image quality of a print image deteriorates. In this embodiment, the image quality of a print image is however improved greatly because the thicknesses of the electrodes are adjusted so that the average ink ejection velocities in the three blocks 51, 52 and 53 are almost equalized. According to this embodiment, the same advantage as obtained in the first embodiment can be also obtained.

Next, a third embodiment of the invention will be described. The inkjet printing head according to this embodiment is partially different from that according to the first embodiment in the number of laminated layers of the individual electrodes 35. That is, the inkjet printing head in this embodiment is the same as that in the first embodiment with respect to the structure shown in FIGS. 1 to 7 but is different from that in the first embodiment with respect to the structure shown in FIGS. 8, 9A, 9B, 10A and 10B. Accordingly, description will be made mainly on the point of difference. Members the same as those in the first embodiment are denoted by the same reference numerals as those in the first embodiment for the sake of omission of duplicated description.

Figure 12A:
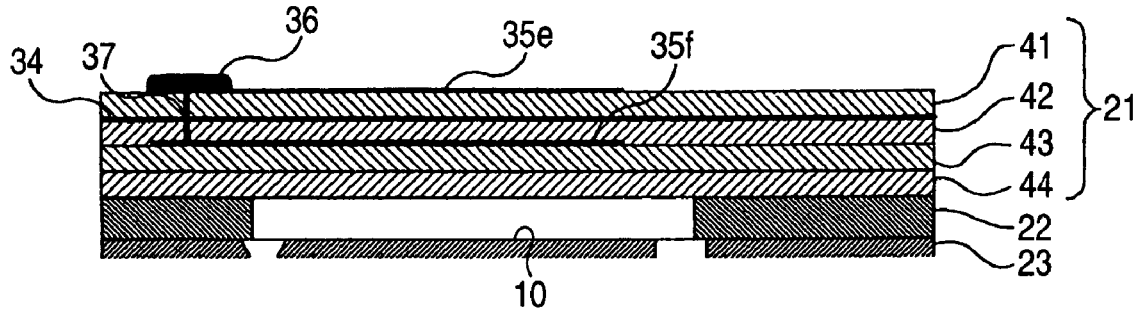
FIG. 12A is a sectional view corresponding to FIG. 10A and showing the head body of the inkjet printing head according to a third embodiment of the invention.
Figure 12B:
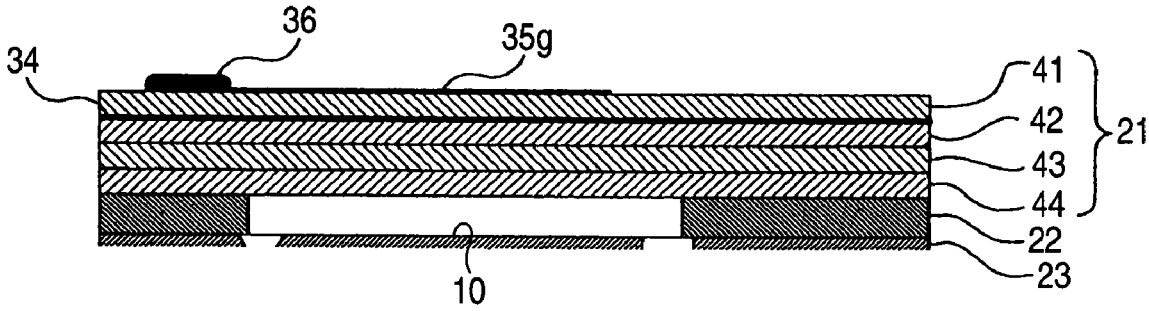
FIG. 12B is a sectional view corresponding to FIG. 10B.

FIG. 12A is a sectional view of the head body according to this embodiment. FIG. 12A corresponds to FIG. 10A. FIG. 12B is a sectional view of the head body according to this embodiment. FIG. 12B corresponds to FIG. 10B. In this embodiment, two 51 and 52 of the three blocks 51, 52 and 53 shown in FIG. 8 are provided so that individual electrodes 35*e* are formed on the piezoelectric sheet 41 while individual electrodes 35*f* are formed between the piezoelectric sheets 42 and 43 so as to be disposed opposite to the individual electrodes 35*e*. On the other hand, individual electrodes 35*g* are formed in the block 53. Each of the individual electrodes 35*e*, 35*f* and 35*g* has the same planar size and thickness as those of the individual electrode 35*a* shown in FIG. 9A.

Through-holes are formed in the piezoelectric sheets 41 and 42 so as to be disposed under the land portions 36 in the blocks 51 and 52. Each through-hole is filled with an electrically conductive material (such as silver or palladium). Accordingly, the two individual electrodes 35*e* and 35*f* in the blocks 51 and 52 are electrically connected to each other through the electrically conductive material, so that the individual electrode 35*f* is controlled to be equalized in electric potential to the individual electrode 35*e*. In the blocks 51 and 52, a region of the piezoelectric sheet 42 sandwiched between the individual electrode 35*f* and the common electrode 34, as well as a region of the piezoelectric sheet 41 sandwiched between the individual electrode 35*e* and the common electrode 34, serves as an active layer. That is, the blocks 51 and 52 of the actuator unit 21 are provided as a unimorph type structure in which the two piezoelectric sheets 41 and 42 on the upper side are formed as active layer-containing layers while the two piezoelectric sheets 43 and 44 on the lower side are formed as non-active layers. On the other hand, the block 53 is provided as a unimorph type structure in which the piezoelectric sheet 41 on the upper side is firmed as an active layer-containing layer while the three piezoelectric sheets 42, 43 and 44 on the lower side are formed as non-active layers.

Theoretically, as the number of laminated layers of the individual electrodes 35 increases, ink ejection velocity increases because larger displacement is generated in the actuator unit 21 by increase in the number of active layers contributing to such displacement even in the case where a predetermined drive voltage is applied. In this embodiment, the average ink ejection velocities in the three blocks 51, 52 and 53 are almost equalized when the number of laminated layers of the individual electrodes 35 in the blocks 51 and 52 is set at 2 while the number of laminated layers of the individual electrodes 35 in the block 53 is set at 1. If the numbers of laminated layers of the individual electrodes 35 in the three blocks 51, 52 and 53 are equal to one another, the mage quality of a print image deteriorates because variation in ink ejection velocity becomes large particularly in the arrangement direction A. In this embodiment, the image quality of a print image is however improved greatly because the numbers of laminated layers of the individual electrodes 35 are adjusted so that the average ink ejection velocities in the three blocks 51, 52 and 53 are almost equalized. According to this embodiment, the same advantage as obtained in the first embodiment can be also obtained.

Although preferred embodiments of the invention have been described above, the invention is not limited to the aforementioned embodiments but various changes may be made on design without departing from the scope of claim. For example, the pressure chambers and the individual electrodes may be arranged not in the form of a matrix but along a direction. In this case, the electrode-facing areas, the thicknesses of the individual electrodes and the numbers of laminated layers of the individual electrodes can be adjusted along the direction.

Although the embodiments have shown the case where the electrode-facing areas, the thicknesses of the individual electrodes, etc. in the actuator unit are adjusted so as to change along the lengthwise direction of the actuator unit, the invention may be also applied to the case where the electrode-facing areas are adjusted so as to change along two directions, that is, the lengthwise direction of the actuator unit and a direction perpendicular to the lengthwise direction, in accordance with variation in velocity of ink ejected from nozzles corresponding to the actuator unit. When variation in velocity of ink ejected from the nozzles in the direction perpendicular to the lengthwise direction of the actuator unit is larger than that in the lengthwise direction, the electrode-facing areas, etc. may be adjusted so as to change along only the direction perpendicular to the lengthwise direction of the actuator unit.

Although the embodiments have shown the case where means for changing the electrode-facing areas, the thicknesses of the individual electrodes or the numbers of laminated layers of the individual electrodes is used as means for adjusting ink ejection velocity, the invention may be also applied to the case where two or more means selected from these means at option are used in combination to adjust the ink ejection velocity.

Although the embodiments have shown the case where the electrode-facing areas, etc. are equalized in accordance with each of the three blocks provided in the actuator unit, the number of blocks may be changed at option. Alternatively, the electrode-facing areas, etc. may be adjusted in accordance with the individual electrodes instead of provision of such blocks in the actuator unit. Although the embodiments have shown the case where the sizes, thicknesses, etc. of the individual electrodes are adjusted suitably so that the velocities of ink ejected from the nozzles in the actuator unit are equalized, the invention is not limited to the case where the velocities of ejected ink are equalized completely. That is, the effect of the invention can be obtained if the difference between the velocities of ink ejected from the nozzles can be reduced to a degree acceptable in practical use compared with the case where the sizes etc. of all the individual electrodes are equalized.

The arrangement of the pressure chambers and the common ink chamber is not limited to the aforementioned embodiments. Various changes may be made on design.

In the above-described embodiments, it is assumed that the flow path unit 4 is made of stainless steel, and the actuator unit 21 is made of a ceramic material. Therefore, the flow path unit 4 has higher thermal expansion coefficient than the actuator unit 21. However, in a case where the flow path unit 4 has lower thermal expansion coefficient than the flow path unit 4, in the case such where the flow path unit 4 is made of a so-called 4-2 alloy, the ink ejecting velocity of each of the nozzles can be adjusted to be equalized by designing the inkjet printing head 1 so that the facing area between the common electrode 34 and the individual electrodes 35, thicknesses of the individual electrodes 35, and the number of laminated layers of the individual electrodes 35 becomes vice versa at the central portion and the edge portion in the actuator unit 21 with respect to the above-described embodiments.

As described above, the embodiments are provided to cope with the phenomenon that the ink ejection velocity in the central portion of the actuator unit is higher than that in the outer edge portion of the actuator unit when the actuator unit of a ceramic material and the flow path unit of a metal material are bonded and fixed to each other while heated. In the embodiments, because the thermal expansion coefficient of the metal flow path unit is higher than that of the ceramic actuator unit, the inventor infers that the factor for making the ink ejection velocity in the central portion higher than that in the outer edge portion is related to the thermal expansion coefficients. It is however impossible to obtain a conclusion that there is no case where the ink ejection velocity in the central portion of the actuator unit is made higher than that in the outer edge portion of the actuator unit by any other factor. If such a case occurs, the ink ejection velocity can be adjusted by means of setting the facing area between the common electrode and the individual electrodes in the outer edge portion of the actuator unit to be smaller than that in the central portion of the actuator unit, by means of setting the thickness of the individual electrodes in the outer edge portion to be larger than that in the central portion or by means of setting the number of active layers in the outer edge portion to be smaller than that in the central portion. It is a matter of course that two or more means selected from these means at option may be used in combination to adjust the ink ejection velocity.

As described above, the inkjet printing head according to a first configuration of the invention has a flow path unit, and an actuator unit, the flow path unit including pressure chambers arranged along a plane so as to be connected to nozzles respectively, the actuator unit being fixed to a surface of the flow path unit for changing the volume of each of the pressure chambers. The actuator unit includes: individual electrodes arranged in positions opposite to the pressure chambers respectively; a common electrode provided to extend over the pressure chambers; and a piezoelectric sheet put between the common electrode and the individual electrodes. The facing area between the common electrode and the individual electrodes in a central portion of the actuator unit is smaller than the facing area between the common electrode and the individual electrodes in an outer edge portion of the actuator unit.

According to the first configuration, because the facing area between the common electrode and the individual electrodes is adjusted in accordance with a place in the actuator unit so that the difference in ink ejection velocity is eliminated, the velocities of ink ejected from the nozzles can be almost equalized regardless of the position of each pressure chamber with respect to the actuator unit. Moreover, it is almost unnecessary to change dimension parameters and control parameters except the planar shapes of the electrodes, so that there is an advantage on design.

Preferably, in the first configuration, the area of the individual electrodes arranged in the central portion of the actuator unit is smaller than the area of the individual electrodes arranged in the outer edge portion of the actuator unit. According to this configuration, the facing area between the common electrode and the individual electrodes can be adjusted easily.

From the point of view of high integration of nozzles, in the first configuration, the individual electrodes may be arranged in the form of a matrix. In this case, particularly when the ink ejection velocities hows a tendency to change along one direction in the actuator unit, it is preferable from the point of view of eliminating the difference in ink ejection velocity that the facing area in the actuator unit changes along a direction.

In this configuration, the actuator unit may be separated into blocks. In this case, it is preferable that the facing area is constant in each of the blocks but the facing area in one block located in the central portion of the actuator unit is smaller than the facing area in another block located in the outer edge portion of the actuator unit. According to this configuration, the actuator unit can be produced easily because the planar shapes of the electrodes can be changed according to the blocks.

In the first configuration, the thickness of each of the individual electrodes in the central portion of the actuator unit may be larger than the thickness of each of the individual electrodes in the outer edge portion of the actuator unit. Even in the case where a large difference is generated between original ink ejection velocities, the ink ejection velocities can be equalized because the difference between the ink ejection velocities can be eliminated by the adjustment of the thickness of each individual electrode as well as by the adjustment of the facing area between the two electrodes.

In another aspect, the inkjet printing head according to a second configuration has a flow path unit, and an actuator unit, the flow path unit including pressure chambers arranged along a plane so as to be connected to nozzles respectively, the actuator unit being fixed to a surface of the flow path unit for changing the volume of each of the pressure chambers. The actuator unit includes: individual electrodes arranged in positions opposite to the pressure chambers respectively: a common electrode provided so as to be common to the pressure chambers; and a piezoelectric sheet put between the common electrode and the individual electrodes. The thickness of each of the individual electrodes in a central portion of the actuator unit is larger than the thickness of each of the individual electrodes in an outer edge portion of the actuator unit.

In a further aspect, the inkjet printing head according to a third configuration has a flow path unit, and an actuator unit, the flow path unit including pressure chambers arranged along a plane so as to be connected to nozzles respectively, the actuator unit being fixed to a surface of the flow path unit for changing the volume of each of the pressure chambers. The actuator unit includes: individual electrodes arranged in positions opposite to the pressure chambers respectively; a common electrode provided so as to be common to the pressure chambers; and piezoelectric sheets put between the common electrode and the individual electrodes. The number of laminated layers of the individual electrodes in the piezoelectric sheets in a central portion of the actuator unit is larger than that in an outer edge portion of the actuator unit.

According to this configuration, because the thickness of each of the individual electrodes or the number of laminated layers of the individual electrodes is adjusted in accordance with each place in the actuator unit so that the difference in ink ejection velocity is eliminated, the velocities of ink ejected from the nozzles can be almost equalized regardless of the position of each pressure chamber with respect to the actuator unit.

In a further aspect, the inkjet printing head according to a fourth configuration has a flow path unit, and an actuator unit, the flow path unit including pressure chambers arranged along a plane so as to be connected to nozzles respectively, the actuator unit being fixed to a surface of the flow path unit for changing the volume of each of the pressure chambers. The actuator unit includes: individual electrodes arranged in positions opposite to the pressure chambers respectively; a common electrode provided so as to extend over the pressure chambers; and a piezoelectric sheet put between the common electrode and the individual electrodes. The facing area between the common electrode and the individual electrodes varies according to a place in the actuator unit.

According to this configuration, because the facing area between the common electrode and the individual electrodes is adjusted in accordance with each place in the actuator unit so that the difference in ink ejection velocity is eliminated, the velocities of ink ejected from the nozzles can be almost equalized regardless of the position of each pressure chamber with respect to the actuator unit. Moreover, it is almost unnecessary to change dimension parameters and control parameters except the planar shapes of the electrodes, so that there is an advantage on design.

In a further aspect, the inkjet printing head according to a fifth configuration includes: a flow path unit including pressure chambers arranged along a plane and connected to nozzles respectively; and an actuator unit being fixed to a surface of the flow path unit and changes volume of each of the pressure chambers, the actuator unit including: a plurality of individual electrodes each arranged in positions opposite to the pressure chambers respectively; a common electrode provided to extend over the pressure chambers; and a piezoelectric sheet provided between the common electrode and the individual electrodes, wherein actuator elements in which configured by laminating each of the individual electrodes, the common electrode and the piezoelectric sheet, are formed in a different structure depending on a position in the actuator unit, the position where each of the actuator elements is disposed.

According to the fifth configuration, by forming the structure of each of the actuator devices differently in accordance with the position in the actuator unit where the actuator device is disposed, the difference in ink ejection velocity is eliminated. Accordingly, the velocities of ink ejected form the nozzles can be almost equalized regardless of the position of each pressure chamber with respect to the actuator unit.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet printing head comprising:

a flow path unit including pressure chambers arranged along a plane and connected to nozzles respectively; and an actuator unit that is fixed to a surface of the flow path unit and changes volume of each of the pressure chambers, the actuator unit including:

a plurality of individual electrodes each arranged in positions opposite to the pressure chambers respectively;

a common electrode provided to extend over the pressure chambers; and a piezoelectric sheet provided between the common electrode and the individual electrodes, wherein actuator elements in which configured by laminating each of the individual electrodes, the common electrode and the piezoelectric sheet, are formed in a different structure depending on a position in the actuator unit, the position where each of the actuator elements is disposed.

2. The inkjet printing head according to claim 1, wherein the individual electrodes are arranged in a form of a matrix in the actuator unit.

3. The inkjet printing head according to claim 1, wherein each of the actuator elements changes volume of the respective pressure chamber when a predetermined voltage is applied between the individual electrode and the common electrode.

4. The inkjet printing head according to claim 1, wherein the individual electrodes are formed in a shape similar to each other.

5. The inkjet printing head according to claim 1, wherein the actuator elements are formed in a different structure depending on a plurality of regions arranged in the actuator unit, the regions where the actuator elements are disposed.

6. The inkjet printing head according to claim 5, wherein the actuator unit is divided into the regions by at least one imaginary dividing line that is parallel to one of edge lines of the actuator unit.

7. The inkjet printing head according to claim 5, wherein the actuator elements are formed in a different structure depending on which of a first region arranged at a central portion of the actuator unit and a second region arranged at a edge portion of the actuator unit each of the actuator elements are disposed.

8. The inkjet printing head according to claim 7, wherein an occupying area of the first region is configured to be larger than an occupying area of the second region.

9. The inkjet printing head according to claim 7, wherein a facing area between the common electrode and the individual electrode of the actuator element that is disposed at the first region is configured to be smaller than a facing area between the common electrode and the individual electrode of the actuator element that is disposed at the second region.

10. The inkjet printing head according to claim 9, wherein an area of the individual electrode of the actuator element that is disposed at the first region is configured to be smaller than an area of the individual electrode of the actuator element that is disposed at the second region.

11. The inkjet printing head according to claim 9, wherein the individual electrodes are arranged in a form of a matrix in the actuator unit.

12. The inkjet printing head according to claim 11, wherein the facing area of the actuator elements is configured to be different along an in-plane direction of the actuator unit and depending on the position where each of the actuator elements is disposed.

13. The inkjet printing head according to claim 7, wherein a thickness of the individual electrode of the actuator elements disposed at the first region is configured to be larger than a thickness of the individual electrode of the actuator elements disposed at the second region.

14. The inkjet printing head according to claim 7, wherein the actuator elements are provided with a different numbers of laminated layers of the individual electrode in the piezoelectric sheet, and wherein a number of laminated layers of the individual electrode in the actuator element provided at the first region is configured to be less than a number of laminated layers of the individual electrode in the actuator element provided at the second region.

15. The inkjet printing head according to claim 1, wherein the actuator elements are formed to have different facing area between the individual electrode and the common electrode depending on the position where each of the actuator elements is disposed.

16. The inkjet printing head according to claim 15, wherein the facing area of the actuator elements is configured to be different along an in-plane direction of the actuator unit and depending on the position where each of the actuator elements is disposed.

17. The inkjet printing head according to claim 15, wherein the actuator elements are configured to have different area of the individual electrode depending on the position where each of the actuator elements is disposed.

18. The inkjet printing head according to claim 1, wherein the actuator elements are configured to have different thickness of the individual electrode depending on the position where each of the actuator elements is disposed.

19. The inkjet printing head according to claim 1, wherein the actuator elements a are configured to have different numbers of laminated layers of the individual electrodes in the piezoelectric sheets depending on the position where each of the actuator elements is disposed.

* * * * *